US010880632B1

(12) United States Patent
Boyd et al.

(10) Patent No.: US 10,880,632 B1
(45) Date of Patent: Dec. 29, 2020

(54) EARPHONES WITH A FORMABLE EAR HOOK

(71) Applicant: Apple Inc., Cupertino, CA (US)

(72) Inventors: Robert A. Boyd, Los Angeles, CA (US); William R. Rochowicz, Manhattan Beach, CA (US); Carlos M. Santana, Granada Hills, CA (US); Sean S. Corbin, San Jose, CA (US); Matthew Costello, Soquel, CA (US); David H. Tan, Chino Hills, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/455,974

(22) Filed: Jun. 28, 2019

(51) Int. Cl.

| | |
|---|---|
| ***H04R 11/02*** | (2006.01) |
| ***H04R 9/02*** | (2006.01) |
| ***H04R 9/06*** | (2006.01) |
| ***H04R 9/04*** | (2006.01) |
| ***G10K 9/13*** | (2006.01) |
| ***H04R 1/10*** | (2006.01) |
| ***H04R 5/033*** | (2006.01) |

(52) U.S. Cl.
CPC ..... *H04R 1/105* (2013.01); *H04R 1/1016* (2013.01); *H04R 1/1066* (2013.01); *H04R 5/0335* (2013.01)

(58) Field of Classification Search
CPC .... H04R 1/1016; H04R 1/105; H04R 1/1066; H04R 5/033; H04R 5/0335
USPC ..... 381/309, 330, 370, 374, 376, 380, 381
See application file for complete search history.

(56) References Cited

U.S. PATENT DOCUMENTS

| | | | | |
|---|---|---|---|---|
| 3,787,643 | A * | 1/1974 | Nielsen | H04R 25/552 381/327 |
| 4,845,751 | A | 7/1989 | Schwab | |
| 5,095,382 | A | 3/1992 | Abe | |
| 5,349,386 | A | 9/1994 | Borchardt et al. | |
| 9,319,769 | B2 | 4/2016 | Burgett et al. | |
| 2004/0037444 | A1 | 2/2004 | Redmer et al. | |
| 2004/0041929 | A1 * | 3/2004 | Lapalme | B21F 1/002 348/275 |
| 2004/0134710 | A1 | 7/2004 | Yang | |
| 2005/0185814 | A1 | 8/2005 | Chen | |
| 2007/0258613 | A1 | 11/2007 | Wright | |

(Continued)

OTHER PUBLICATIONS

Web page: Sony, "Full Specifications and Features," WS620 WALKMAN® WS Series, printed on Jun. 27, 2019.

(Continued)

*Primary Examiner* — Jesse A Elbin
(74) *Attorney, Agent, or Firm* — Kilpatrick Townsend & Stockton LLP

(57) ABSTRACT

An earphone comprising an ear hook having a body the bulk of which is made from a flexible material molded over a formable member and a plurality of wires. The ear hook includes a first end and a second end and a curved portion in between. The earphone further includes an earbud coupled to the first end of the ear hook and coupled to the plurality of wires. The plurality of wires extends within the ear hook along its length from the first end to the second end exiting the ear hook at the second end. The formable member extends within the ear hook from the first end along a portion of the ear hook length towards the second end and enables the ear hook to be bent along a portion of its length while retaining its bent shape.

18 Claims, 5 Drawing Sheets

(56) References Cited

U.S. PATENT DOCUMENTS

| | | | | |
|---|---|---|---|---|
| 2008/0075316 | A1* | 3/2008 | Chan | H04R 1/105 381/381 |
| 2008/0080704 | A1 | 4/2008 | Te Riet | |
| 2008/0187164 | A1 | 8/2008 | Chou | |
| 2008/0310666 | A1 | 12/2008 | Wengreen | |
| 2009/0022352 | A1 | 1/2009 | Weibel | |
| 2009/0135017 | A1 | 5/2009 | Lee et al. | |
| 2011/0170703 | A1 | 7/2011 | Palma | |
| 2012/0070028 | A1 | 3/2012 | Margulies | |
| 2014/0334658 | A1* | 11/2014 | Wang | B29C 45/14639 381/381 |
| 2016/0323665 | A1* | 11/2016 | Wickstrom | H04R 1/1075 |
| 2019/0349659 | A1* | 11/2019 | Ott | H04R 1/1066 |
| 2020/0077170 | A1* | 3/2020 | Wexler | H04R 1/1016 |

OTHER PUBLICATIONS

Web page: PC, "JBL Endurance Jump," by Tim Gideon, JBL Endurance Jump Review & Rating | PCMag.com printed on Jun. 27, 2019 at https://www.pcmag.com/review/366133/jbl-endurance-jump.

* cited by examiner

EARPHONES WITH A FORMABLE EAR HOOK

FIELD OF THE INVENTION

The present invention pertains generally to earphones and more specifically to earphones that include an ear hook that assists in securing the earphone to a user's ear.

BACKGROUND

Traditional headphones are designed to be worn on or around a user's head and include left and right earcups (or earpads) connected to each other by a headband. The headband and earcups combine to secure the headphones to a user's head. Earphones, by way of contrast, do not include a headband or bulky ear cups or ear pads that press against a user's head. Instead, earphones include a small speaker that fits within a user's ear canal or rests inside the edge of a user's ear.

Some earphones include a partial loop (commonly referred to as an "ear hook") that fits between a user's skull and outer ear and loops or hooks over the portion of the ear that is connected to the skull. Ear hooks can be used with both wired and wireless earphones and can provide improved wearing comfort while helping better secure the earphones to a user's ear.

While many different earphone and ear hook designs have been developed, new and improved designs are continuously being sought.

SUMMARY

Various embodiments of the invention pertain to an earphone that includes an ear hook that can provide improved wearing comfort and an improved user experience with the earphones. The ear hook can include a first end and a second end and a curved portion in between. A body of the ear hook can be made from a flexible material molded over a formable member and a plurality of wires. The formable member can extend within the ear hook from the first end along a portion of the ear hook length towards the second end and can enable the ear hook to be bent along a portion of its length while retaining its bent shape. The plurality of wires can also extend within the ear hook along its length from the first end to the second end exiting the ear hook at the second end. Some embodiments of earphones according to the invention can further include an attachment mechanism that secures an earbud to the ear hook in an efficient and attractive manner forming a water tight seal between the two components.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION

The present invention will now be described in detail with reference to certain embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known details have not been described in detail in order not to unnecessarily obscure the present invention.

Figure 1:
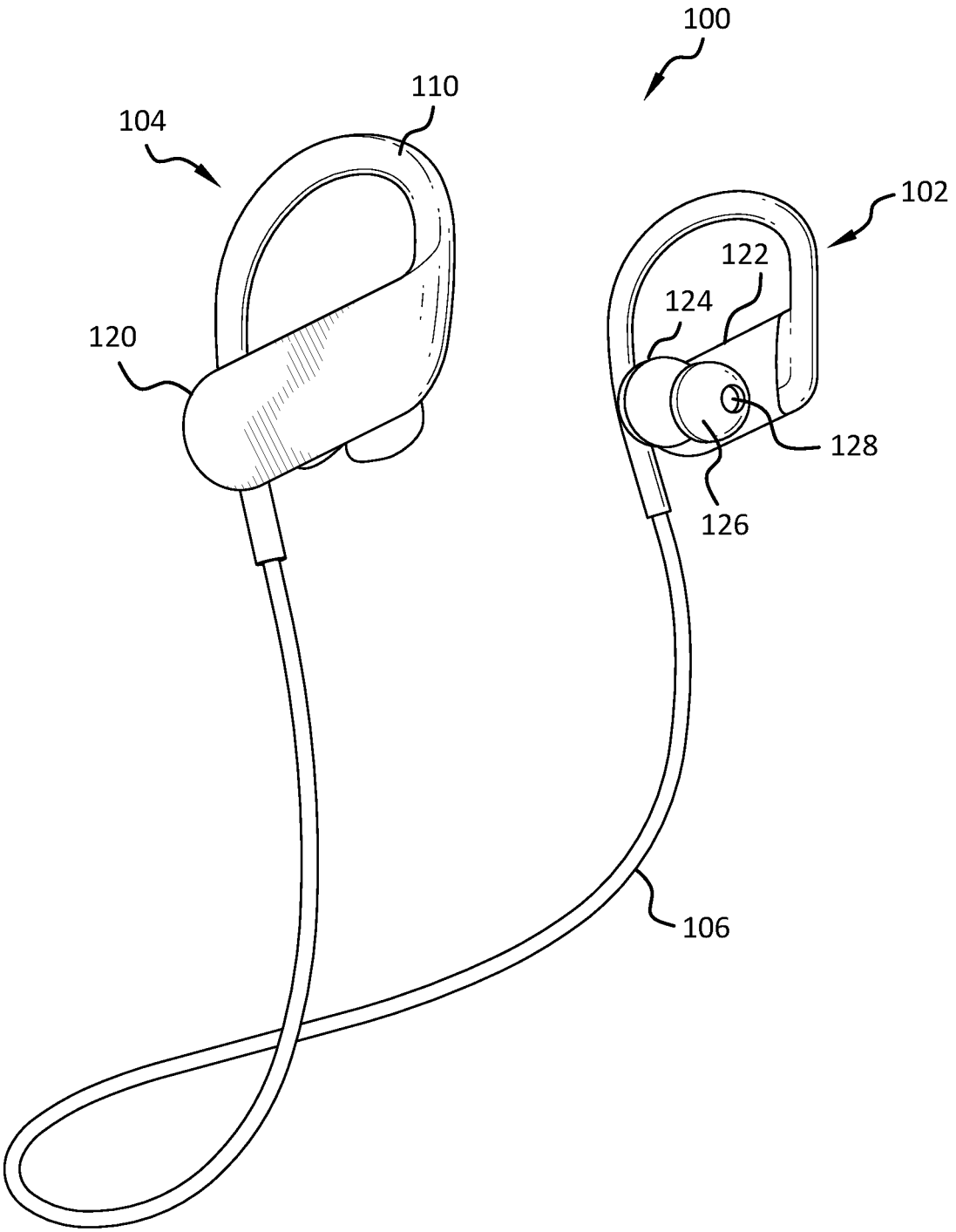
FIG. 1 is a perspective view of a pair of earphones according to an embodiment of the invention.

In order to better appreciate and understand the present invention, reference is first made to FIG. 1, which is a perspective view of a pair of wireless earphones 100 according to an embodiment of the invention. Wireless earphones 100 include left ear and right ear pieces 102, 104 coupled to each other by a flexible cable 106. Each of the ear pieces 102, 104 includes an ear hook 110 and an earbud 120. As used herein, the term "earbud" includes both in-ear earphones, sometimes referred to as canal phones, that are inserted in the ear canal itself such as earbud 120 as well as small earphones that fit within a user's outer ear facing the ear canal without being inserted into the ear canal. Each of the individual earbuds 120 depicted in FIG. 1 is of the in-ear earphone type, but embodiments of the invention are not limited to such and can be used with any type of earbud as well as with hearing aids and other small listening devices that are designed to sit within a user's ear.

Each earbud 120 includes an earbud housing that includes a primary housing 122 and a speaker housing 124 that can be integrally formed together or separate housing components attached to each other. Each earbud also includes an earbud tip 126 that is configured to be inserted within a user's ear canal. A speaker, not shown in FIG. 1, can be positioned within the speaker housing 124 and aligned with an acoustic port (not shown) through the housing 124 that delivers sound from the speaker through an opening 128 of earbud tip 126 into a user's ear canal.

Cable 106 can include a plurality of wires (not shown in FIG. 1) that transmit electrical signals between the left and right earbuds 120. For example, in some embodiments a wireless receiver can be included in one of the ear pieces 102, 104 and configured to wirelessly receive an audio signal stream that can be played over earphones 100. The audio stream can include audio signals for left and right audio channels with one of the channels being transmitted to the user through the earbud at which the wireless receiver is located and the other audio channel being transmitted to the other earbud via cable 106. In some embodiments cable 106 can be sized to loop around the back of a user's neck so that one or both earpieces 102, 104 can be removed from a user's ear and hang from the user's neck as a matter of convenience.

Ear hook 110 can include a body made from an elastomeric or other flexible material that defines an outer shape of the ear hook and includes a curved or generally u-shaped form enabling the ear hook to be positioned or hooked over the portion of a user's ear that is connected to his or her skull. In this manner, each ear hook 110 can help secure the earbuds 120 to a user's ear. To further improve the comfort level and user experience of wireless earphones 100, each ear hook 110 according to embodiments of the invention can be formable. That is, each ear hook 110 can include a portion that can be bent along its length to a desired shape and retain that shape to provide a better fit for individual users.

Figure 2:
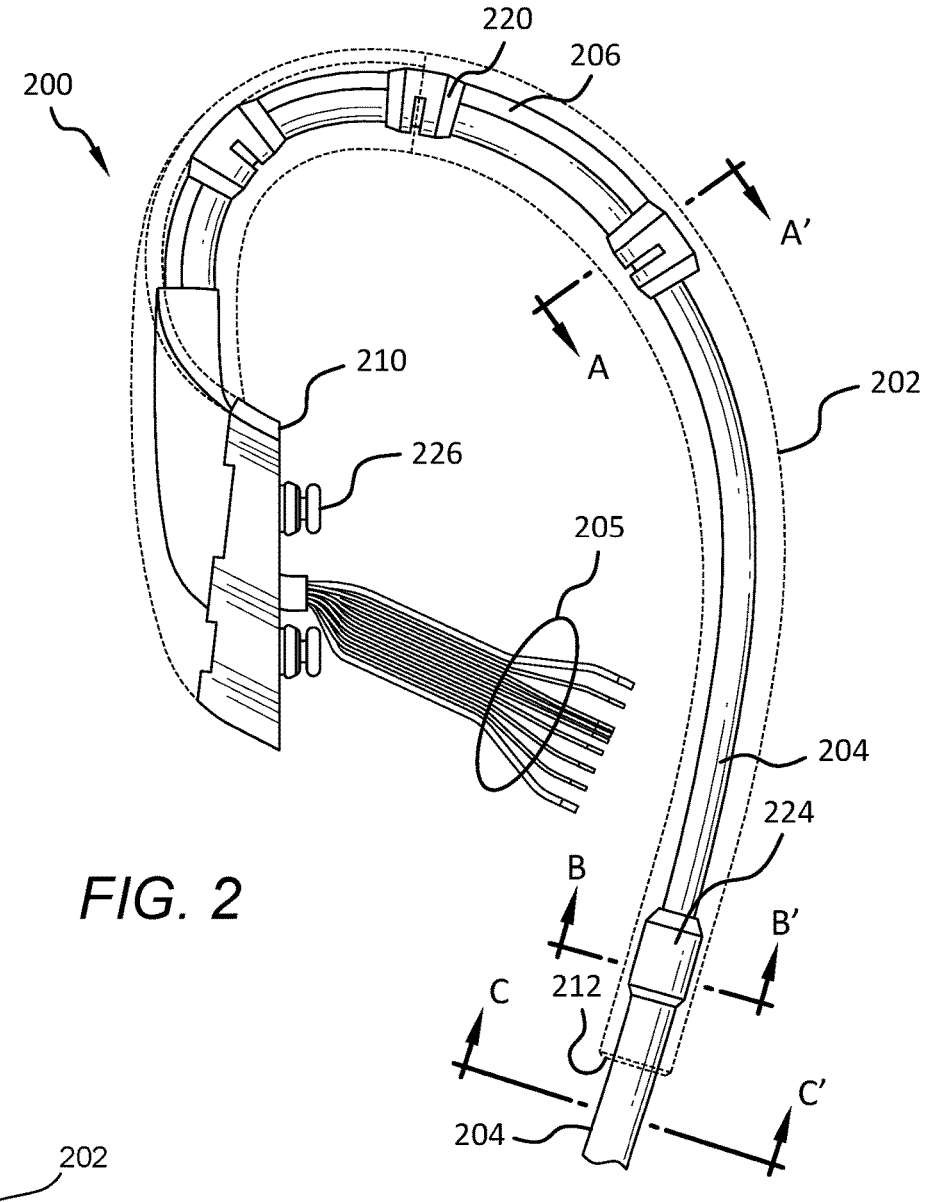
FIG. 2 is a simplified view of a portion of an ear hook according to some embodiments that can be included for each of the left and right earphones in the embodiment depicted in FIG. 1.

FIG. 2 is a simplified view of an ear hook 200 according to some embodiments that can be representative of ear hook 110 shown in FIG. 1. As shown, ear hook 200 includes a body 202 that can be made from flexible material, such as elastomeric or similar material, that is molded or otherwise formed over various inner components of the ear hook forming a unibody structure for the ear hook. In some embodiments, body 202 can be made from a thermoplastic elastomer (TPE) which is a combination of rubber and plastic.

Body 202 is shown in FIG. 2 in transparent form with dotted lines so that the inner components of the ear hook can also be illustrated in the figure. Such inner components can include a cable 204 and a formable member 206. Cable 204 can be representative of cable 106 and include a plurality of wires 205 surrounded by an insulating jacket. Cable 204 can be embedded within ear hook 200 along the entire length of the ear hook from a first end 210 at which the individual wires 205 can be electrically connected to an earbud to a second end 212 from which the cable exits at an angle generally parallel to the length of the ear hook at its second end.

Formable member 206 can extend from the first end 210 of the ear hook along a portion of the length of the ear hook. For example, in some embodiments formable member extends along approximately ½ to ¾ of the length of ear hook 210, and in some embodiments formable member 206 can be between 2 to 6 inches in length. Formable member 206 provides structure to ear hook 210 and is bendable into different positions in which a portion of the ear hook will retain the general shape of the formable member. As would be understood by a person of ordinary skill in the art, the shape retention feature of the ear hook can be limited in some instances by the thickness and materials of components of and within the ear hook, such as body 202 and cable 204. That is, while the ear hook can be bent a reasonable amount to better accommodate different ear sizes of various users, there will be a limit to the radius or angle of any such bends based on the materials and components used to form the ear hook.

In some embodiments, formable member 206 can be a formable wire, for example, a stainless steel wire of approximately 1 mm in diameter. Embodiments are not limited to any particular material or shape of formable member 206, however, and in other embodiments materials other than stainless steel and components other than a bendable wire can be employed.

Formable member 206 can be attached to cable 204 by one or more strain relief fasteners 220 spaced apart along a portion of the length of the formable member. For example, in the embodiment shown in FIG. 2, three strain relief members 220 are spaced along the length of member 206 with one of the strain relief members positioned at an end point of formable member 206. In some embodiments, the strain relief fasteners include a cutout 222 that faces the u-bend of the ear hook and enables the fasteners to flex inward to accommodate ear hook 200 being bent into various shapes to better conform the ear hook over a user's ear. Cutout 222 can be, for example, approximately half the diameter of each fastener.

Figure 3:
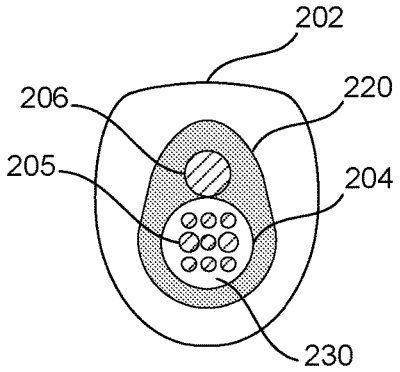
FIG. 3 is a cross-sectional view of a of a portion of the ear hook shown in FIG. 2 taken along lines A-A'.

Each strain relief fastener 220 can be made from a rigid material, such as polypropylene, and in some embodiments can be molded over cable 204 and formable member 206. For example, reference is now made to FIG. 3, which is a cross-sectional view of a strain relief fastener 220 taken along lines A-A' of FIG. 2. As shown in FIG. 3, formable member 206 can be located adjacent to cable 204 and in some embodiments can be positioned directly over the cable. Cable 204 can include multiple insulated wires 205 surrounded by an inner insulating jacket 230, for example an extruded thermoplastic elastomer (TPE) jacket. The strain relief fastener 220 can be molded directly over formable member 206 and cable 204, and the body 202 of ear hook 200 can then be molded over the assembly of the strain relief fastener, formable member and cable to provide a desired outer shape to the ear hook.

Figure 4:
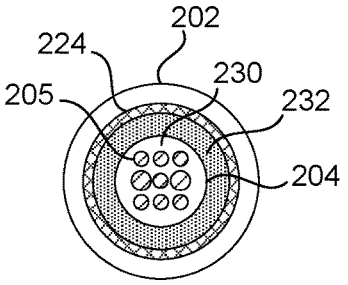
FIG. 4 is a cross-sectional view of a portion of the ear hook shown in FIG. 2 taken along lines B-B'.
Figure 5:
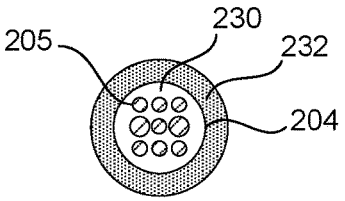
FIG. 5 is a cross-sectional view of flexible cable 204 extending out of the ear hook shown in FIG. 2 taken along lines C-C'.

Reference is now made to FIGS. 2, 4 and 5 where FIG. 4 is a cross-sectional view of a portion of the ear hook shown in FIG. 2 taken along lines B-B' and FIG. 5 is a cross-sectional view of flexible cable 204 extending out of the ear hook shown in FIG. 2 taken along lines C-C'. As shown in FIGS. 2 and 5, the portion of cable 204 that exits the ear hook from second end 212 can include a protective outer cable jacket 232 formed over inner insulating jacket 230. Outer jacket 232 can extend into a portion of ear hook 200 and can be, for example, formed from another layer of thermoplastic elastomer or similar material that provides added strength, environmental and insulation protection for wires 205. An additional strain relief fastener 224 can be formed over cable 204 at the location at which outer jacket 232 ends as shown in FIG. 4. Similar to strain relief fasteners 220, strain relief fastener 224 can also be made from a rigid material, such as polypropylene, and molded over cable 204. And, since fastener 224 is near the end 212 of the ear hook which is beyond the portion of ear hook 200 that can be bent and retain the bent shape, in some embodiments fastener 224 does not include a cutout or similar feature that enables fasteners 220 to be bent with the ear hook.

Ear hook 200 can be part of an ear piece, such as one of the left-ear or right-ear earpieces 102, 104 discussed above with respect to FIG. 1, and thus can include an earbud coupled to the ear hook at first end 210. In some embodiments an earbud can be attached to the ear hook by two attachment posts 226 (shown in FIG. 2) that extend out of first end 210 and a clip (not shown in FIG. 2). Further details on the attachment of an earbud to an ear hook according to embodiments of the invention are described below with respect to FIGS. 6-9.

Figure 6:
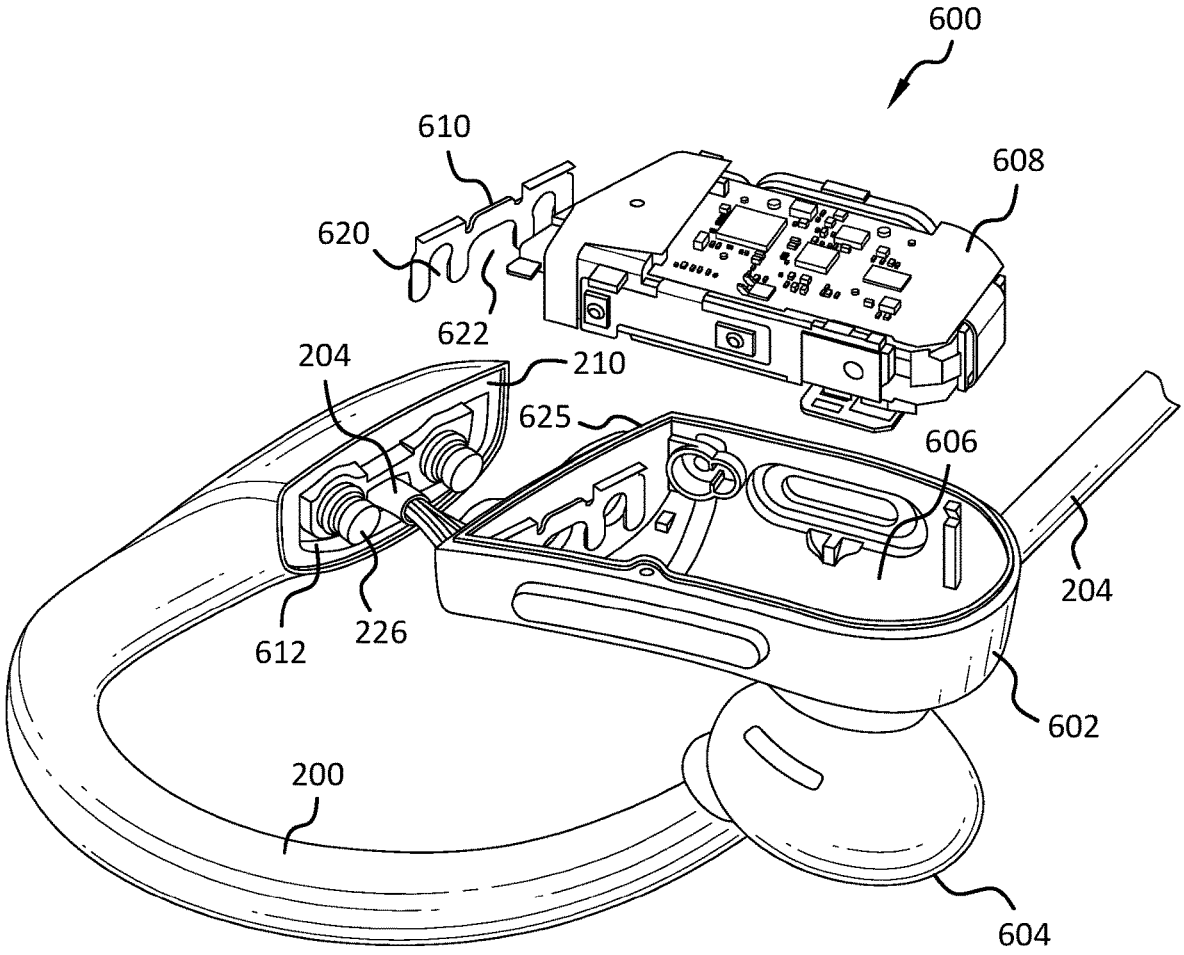
FIG. 6 is a simplified exploded perspective view depicting the attachment of a earbud housing to an ear hook according to some embodiments of the invention.
Figure 7:
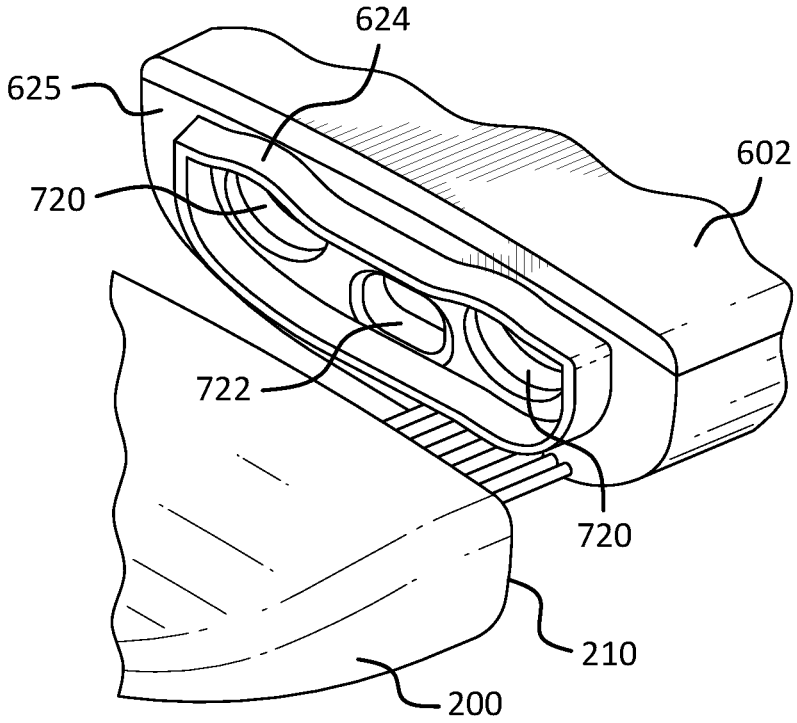
FIG. 7 is a simplified perspective view of the earbud housing and ear hook shown in FIG. 6 spaced apart prior to be connected to each other.
Figure 8:
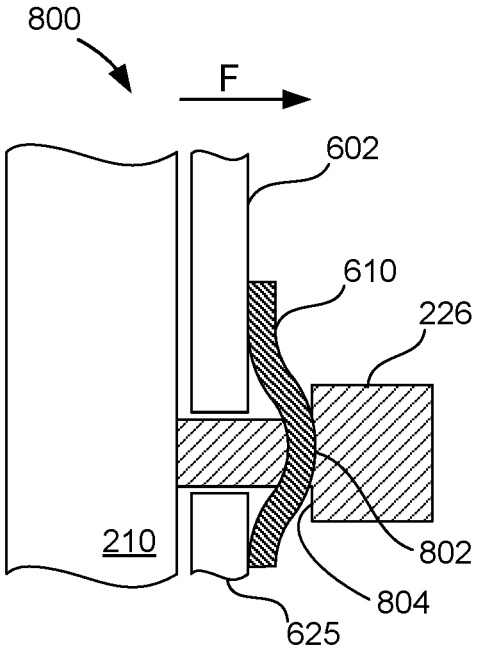
FIG. 8 is a simplified, cross-sectional view of the earbud housing and ear hook shown in FIGS. 6 and 7 coupled together.
Figure 9:
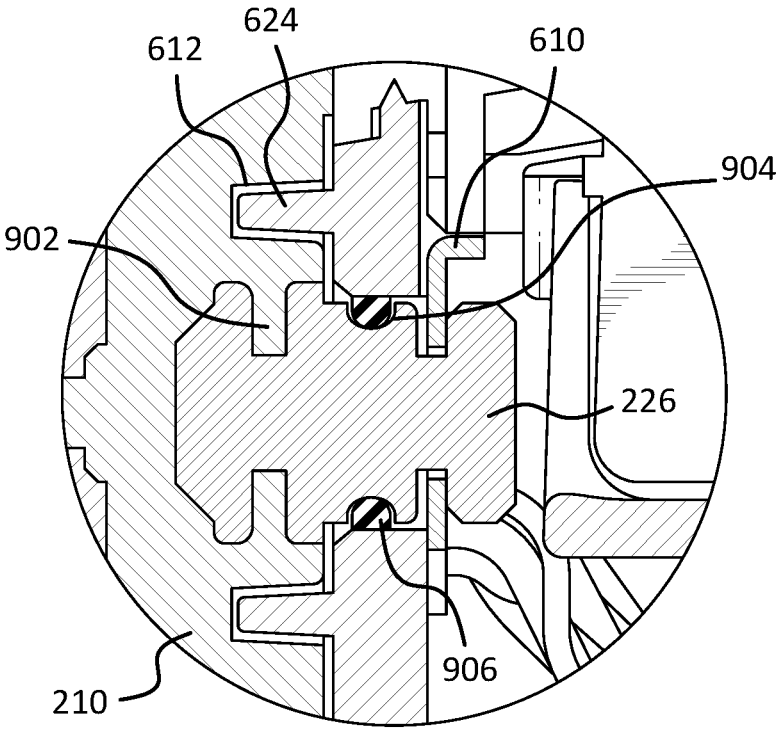
FIG. 9 is a more detailed, exploded view of the earbud housing and ear hook shown in FIGS. 6 and 7 coupled together.

FIG. 6 is a simplified exploded perspective view depicting components of an earbud 600 that can be attached to ear hook 200 in accordance with some embodiments of the invention. FIG. 7 is a simplified perspective view of a portion of earbud 600 and ear hook 200 spaced apart from each other prior to being coupled together. FIG. 8 is a simplified cross-sectional view of portions of the earbud and ear hook shown in FIGS. 6 and 7 coupled together, and FIG. 9 is a simplified enlarged view of portions of earbud 600 and ear hook 200 coupled together. In each of FIGS. 6-9, earbud 600 can be representative of earbuds 120 shown in FIG. 1.

As shown in FIGS. 6-9, earbud 600 includes an earbud housing that includes a primary housing 602 and a speaker housing 604 that extends away from the primary housing. In some embodiments primary housing 602 and speaker housing 604 can be integrally formed with each other and in other embodiments the two housings can be separate components connected to each other to form the earbud housing. Primary housing can include a cavity 606 into which a circuit board assembly 608 can be housed. Circuit board assembly 608 can include various electronic components and circuitry, including one or more integrated circuits, that control the operation of wireless earphones as would be known to those of skill in the art. Speaker housing 604 can include an acoustic port and a cavity (not shown) in which a speaker (also not shown) can be positioned within and aligned to emit sound through the acoustic port. In embodiments where earbud 600 is of the in-ear variety, the earbud can also include an earbud tip 612 that has an opening aligned with the acoustic port and can be made from a deformable material that allows the earbud tip to be inserted within a user's ear canal to form an acoustic seal within the ear canal.

Primary housing 602 can also include a lip 624 (most clearly shown in FIG. 7) that protrudes from an end surface 625 to surround openings 720 and an opening 722. Lip 624 can fit within a matching groove 612 formed at the first end 210 of the ear hook to facilitate alignment and connection between the two components. Openings 720 are sized and shaped to allow attachment posts 226 to be inserted into housing 602. Opening 722 is aligned with a location at which cable 204 exits ear hook 200 and is sized and shaped to accept the cable into housing 602.

When attachment posts 226 are fully inserted through openings 720, a retention clip 610 can be slid over posts 226 to secure earbud 600 to ear hook 200 as shown in more detail in FIGS. 8 and 9. Retention clip 610 can be made from a metal or similar material and can include a pair of openings 620 that enable the retention clip to be slid over posts 226 and an additional opening 622 that enables cable 204 to pass through the retention clip. The retention clip can further include a spring portion 802 that engages an inner surface 804 of each attachment post 226 as shown in FIG. 8. Spring portion 802 imparts a force (F) against the retention clips 226 pulling first end 210 of ear hook 200 towards surface 625 of primary housing 602.

Attachment posts 226 can include one or more anchors 902 that secure the posts to ear hook 200. For example, as shown in FIG. 9, attachment posts 226 can include a groove around a base of each post that allows the elastomeric or similar material 202 from which the bulk of the ear hook is made to be molded within the anchor region securely anchoring posts 226 to the ear hook. Additionally, attachment posts 226 can further include a second groove 904 at a location of the post that protrudes from ear hook 200. The second groove can house an o-ring 906 that, combined with lip 624 and the force imparted by retention clip 610 provides a strong water tight connection between ear hook 200 and housing 602.

From the foregoing, it will be appreciated that specific embodiments of the invention have been described herein for purposes of illustration, but that various modifications can be made without deviating from the spirit and scope of the various embodiments of the invention. For example, while one specific configuration of an earphone is depicted in FIG. 1, embodiments of the disclosure are not limited to such a specific implementation. In other embodiments, an ear hook according to the disclosure can be used with earphones having configurations quite different from that of earphones 100. As one example, in some embodiments, earphones according to the disclosure can be wired earphones in which the flexible cable connects the earphones to an audio source, such as a smart phone, tablet computer, laptop computer, etc. Further, while various advantages associated with certain embodiments of the invention have been described above in the context of those embodiments, other embodiments can also exhibit such advantages, and not all embodiments need necessarily exhibit such advantages to fall within the scope of the invention. Accordingly, the invention is not limited, except as by the appended claims.

References throughout the foregoing description to features, advantages, or similar language do not imply that all of the features and advantages that can be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification can, but do not necessarily, refer to the same embodiment.

Furthermore, the described features, advantages, and characteristics of the present invention can be combined in any suitable manner in one or more embodiments. One skilled in the relevant art will recognize that the present invention can be practiced without one or more of the specific features or advantages of a particular embodiment. In other instances, additional features and advantages can be recognized in certain embodiments but may not be present in all embodiments of the present invention.

Also, it is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

W here the context permits, words in the above Detailed Description using the singular or plural number can also include the plural or singular number respectively. The word "or," in reference to a list of two or more items, covers all of the following interpretations of the word: any of the items in the list, all of the items in the list, and any combination of the items in the list. Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

What is claimed is:

1. An earphone comprising:

a first earbud comprising:

an ear hook having a body comprising flexible material molded over a formable member and a plurality of wires, the ear hook having a first end and a second end that define a length of the ear hook and a curved portion in between the first and second ends; and an earbud housing coupled to the first end of the ear hook and coupled to the plurality of wires;

wherein the plurality of wires extends within the ear hook along its length from the first end to the second end exiting the ear hook at the second end forming part of a cable that electrically couples the first earbud to a second earbud of the earphone enabling audio signals to be transferred between the first and second earbuds; and wherein the formable member comprises a stainless steel wire and extends within the ear hook from the first end along a portion of the ear hook length towards the second end, the formable member enabling the ear hook to be bent along a portion of its length and retain its bent shape; and wherein the formable member is coupled to the plurality of wires by a plurality of rigid fasteners spaced apart along a portion of the length of the ear hook, and wherein the flexible material is molded over the plurality of rigid fasteners.

2. The earphone set forth in claim 1 wherein the formable member extends between one-half to three-quarters of the length of the ear hook.

3. The earphone set forth in claim 1 wherein the formable member extends between 2-6 inches along the length of the ear hook.

4. An earphone comprising:

an ear hook having a body comprising flexible material molded over a formable member and a plurality of wires, the ear hook having a first end and a second end that define a length of the ear hook and a curved portion in between the first and second ends; and an earbud coupled to the first end of the ear hook and coupled to the plurality of wires;

wherein the plurality of wires extends within the ear hook along its length from the first end to the second end exiting the ear hook at the second end;

wherein the formable member extends within the ear hook from the first end along a portion of the ear hook length towards the second end, the formable member enabling the ear hook to be bent along a portion of its length and retain its bent shape; and wherein the earbud is coupled to the first end of the ear hook by a pair of posts that extend away from the first end of the ear hook through openings in an end of the earbud.

5. The earphone set forth in claim 4 further comprising a retention clip positioned within the earbud housing, the retention clip including first and second cutouts sized to accommodate the pair of posts.

6. The earphone set forth in claim 5 wherein the retention clip includes a curved portion that imparts a force against the posts forcing the ear hook and earbud housing together.

7. An earphone comprising:

an earbud housing;

a speaker disposed within the earbud housing;

an ear hook coupled at a first end to the earbud housing and having a second end opposite the first end;

a formable member formed within the ear hook and extending from the first end along a portion of a length of the ear hook towards the second end, the formable member enabling the ear hook to be bent along a portion of its length and retain its bent shape; and a flexible cable including a plurality of wires coupled to the speaker and extending through a length of the ear hook exiting from the second end;

wherein the ear hook includes a body that includes a curved portion between the first and second ends and is formed from an elastomeric material molded over a portion of the flexible cable and the formable member;

wherein the earbud housing is coupled to the first end of the ear hook by a pair of posts that extend away from the first end of the ear hook through openings in an end of the earbud.

8. The earphone set forth in claim 7 wherein the formable member comprises a stainless steel wire.

9. The earphone set forth in claim 8 wherein the formable member is coupled to the flexible cable by a plurality of rigid fasteners spaced apart along a portion of the length of the ear hook, and wherein the elastomeric material is molded over the plurality of rigid fasteners.

10. The earphone set forth in claim 9 wherein each rigid fastener in the plurality of rigid fasteners includes a cutout section that faces inward towards the curved portion of the ear hook.

11. The earphone set forth in claim 7 wherein the flexible cable includes a first cable jacket surrounding the plurality of wires with the ear hook and a second cable jacket surrounding the plurality of wires along a length of the flexible cable that extends past the second end of the ear hook.

12. The earphone set forth in claim 11 further comprising a strain relief jacket molded over the plurality of wires at a junction where the first cable jacket meets the second cable jacket.

13. The earphone set forth in claim 7 further comprising a retention clip positioned within the earbud housing, the retention clip including first and second cutouts sized to accommodate the pair of posts.

14. The earphone set forth in claim 13 wherein the retention clip includes a curved portion that imparts a force against the posts forcing the ear hook and earbud housing together.

15. A pair of earphones comprising:

first and second ear pieces;

a flexible cable coupled between the first and second ear pieces, the flexible cable including a plurality of insulated wires that transmit electrical signals between the first and second ear pieces and that are surrounded by an insulating jacket;

wherein each of the first and second ear pieces comprises:

an ear hook having a body comprising flexible material molded over a formable member, the ear hook having a first end and a second end that define a length of the ear hook and a curved portion in between the first and second ends; and an earbud coupled to the first end of the ear hook and coupled to the plurality of wires;

wherein the plurality of insulated wires extends from the flexible cable into the second end of the ear hook and through a length of the body of the ear hook to the first end of the ear hook and to the earbud; and wherein the formable member extends within the ear hook from the first end along a portion of the ear hook length towards the second end, the formable member enabling the ear hook to be bent along a portion of its length and retain its bent shape; and wherein the formable member is coupled to the flexible cable by a plurality of rigid fasteners spaced apart along a portion of the length of the ear hook, and wherein the flexible material is molded over the plurality of rigid fasteners.

16. The pair of earphones set forth in claim 15 wherein the formable member comprises a stainless steel wire.

17. An earphone comprising:

a first earbud comprising:

an ear hook having a body comprising flexible material molded over a formable member and a plurality of wires, the ear hook having a first end and a second end that define a length of the ear hook and a curved portion in between the first and second ends; and an earbud housing coupled to the first end of the ear hook and coupled to the plurality of wires;

wherein the plurality of wires extends within the ear hook along its length from the first end to the second end exiting the ear hook at the second end forming part of a cable that electrically couples the first earbud to a second earbud of the earphone enabling audio signals to be transferred between the first and second earbuds; and wherein the formable member extends within the ear hook from the first end along a portion of the ear hook length towards the second end, the formable member enabling the ear hook to be bent along a portion of its length and retain its bent shape; and wherein the first earbud includes a wireless receiver configured to wirelessly receive an audio signal stream that can be played over the earphones and the plurality of insulated wires transmits an audio signal from the first earbud to the second earbud.

18. The pair earphones set forth in claim 15 wherein one of the first and second ear pieces includes a wireless receiver configured to wirelessly receive an audio signal stream that can be played over the earphones and the plurality of insulated wires transmits an audio signal from the ear piece that includes the wireless receiver to the other of the first and second ear pieces.

* * * * *